US008542860B2

(12) United States Patent
Scheel et al.

(10) Patent No.: US 8,542,860 B2
(45) Date of Patent: Sep. 24, 2013

(54) OSCILLATOR FOR A FLAT LOUDSPEAKER, FLAT LOUDSPEAKER AND VEHICLE

(75) Inventors: Henning Scheel, Hamburg (DE); Frank Cordes, Stade (DE)

(73) Assignee: Airbus Operations GmbH, Hamburg (DE)

( * ) Notice: Subject to any disclaimer, the term of this patent is extended or adjusted under 35 U.S.C. 154(b) by 347 days.

(21) Appl. No.: 12/827,285

(22) Filed: Jun. 30, 2010

(65) Prior Publication Data

US 2010/0329486 A1 Dec. 30, 2010

Related U.S. Application Data

(63) Continuation of application No. PCT/EP2008/050064, filed on Jan. 4, 2008.

(60) Provisional application No. 61/010,003, filed on Jan. 4, 2008.

(51) Int. Cl.
*H04R 25/00* (2006.01)

(52) U.S. Cl.
USPC ..... 381/384

(58) Field of Classification Search
USPC ..... 381/384
See application file for complete search history.

(56) References Cited

U.S. PATENT DOCUMENTS

| | | | |
|---|---|---|---|
| 8,247,930 | B2 | 8/2012 | Yamagishi |
| 2006/0145376 | A1 | 7/2006 | Hager et al. |

FOREIGN PATENT DOCUMENTS

| | | | |
|---|---|---|---|
| EP | 1207716 | A2 | 5/2002 |
| JP | 2004-356868 | | 12/2004 |
| JP | 2006-025370 | | 1/2006 |
| RU | 2179788 | C2 | 2/2002 |
| RU | 2246802 | C2 | 5/2003 |
| WO | WO 98/34320 | | 8/1998 |
| WO | WO 2007/046836 | | 4/2007 |
| WO | WO 2007/108199 | | 9/2007 |
| WO | WO 2007/139046 | | 12/2007 |

OTHER PUBLICATIONS

International Search Report and Written Opinion for Application Serial No. PCT/EP2008/050064 dated Oct. 22, 2008.
Notice of Grant for Russian Application No. 2010130430/28(043188) dated Dec. 14, 2011.
Japanese Office Action for JP 2010-541036 dated Jul. 17, 2012.

*Primary Examiner* — Jeffrey Donels
(74) *Attorney, Agent, or Firm* — Jenkins, Wilson, Taylor & Hunt, P.A.

(57) ABSTRACT

The present invention relates to an oscillator, particularly for or in a flat loudspeaker, particularly for use in the aerospace field, comprising an oscillating part carrier, a coupling ring for coupling the oscillator to a sound converter of a loudspeaker, wherein the oscillating part carrier and the coupling ring are connected to each other via a detachable quick-release closure, comprising first closing elements for a locked, secure connection in relation to vibrations and second closing elements that are separate from the first closing elements, for a secure connection between the oscillating part carrier and the coupling ring. The invention further relates to a flat loudspeaker comprising such an oscillator and to a vehicle comprising such a flat loudspeaker.

23 Claims, 5 Drawing Sheets

(A-A)

OSCILLATOR FOR A FLAT LOUDSPEAKER, FLAT LOUDSPEAKER AND VEHICLE

CROSS-REFERENCE TO RELATED APPLICATIONS

This application is a continuation of PCT/EP2008/050064 filed Jan. 4, 2008 and claims the benefit of U.S. Provisional Application No. 61/010,003, filed Jan. 4, 2008, the entire disclosure of which is herein incorporated by reference.

FIELD OF THE INVENTION

The present invention relates to a vibration exciter for a flat loudspeaker, in particular in the field of aviation and aerospace. The invention further relates to a flat loudspeaker having such a vibration exciter and a vehicle having such a flat loudspeaker.

Although applicable in principle to any type of loudspeaker, the present invention and the problem which it addresses is explained below with reference to a flat loudspeaker and in particular for a vibration exciter for exciting a panel for such a flat loudspeaker but without limiting the invention in that regard. The present invention is also explained below in connection with a passenger aircraft although it can also be used for other applications and fields.

A loudspeaker is an electromechanical component which converts electrical signals into airborne sound signals. Such loudspeakers are widespread in extremely varied forms. In current loudspeaker systems in aircraft cabins of passenger aircraft, there are used for reproducing spoken announcements conventional electrodynamic loudspeakers which are integrated, for example, in a supply duct above the rows of seats. They have, because of the minimum size of the loudspeaker diaphragm necessary for reproduction of fundamental sound in the medium and high-frequency sound range, strong directivity which currently results in non-uniform sound distribution of those spoken announcements in the cabin.

This can be overcome by using so-called flat loudspeakers in place of conventional electrodynamic loudspeakers. Such flat loudspeakers which are also often referred to as flat diaphragm loudspeakers have a vibration generator which is also referred to as an exciter or transducer. The vibration exciter is coupled to a panel-like sound transducer in order to cause it to vibrate and consequently to generate acoustic sound waves. The term "panel" in the present patent application is intended to refer to a substantially flat, level but not necessarily planar component which can be formed, when used as a flat loudspeaker in an aircraft, for example, by a portion of the inner covering of the aircraft cabin and which has the function of the sound transducer of the flat loudspeaker.

FIGS. 1 and 1A show the basic structure of a known vibration exciter for a flat loudspeaker, as described, for example, in WO 98/34320. That vibration exciter 1 which is circular in a plan view (FIG. 1A) comprises a resilient system 2, a coil 3 and a magnetic system 4. The circular coil 3 is firmly connected to the panel 5 of the flat loudspeaker. Flexural waves can be induced in the panel 5 by means of the coil 3. The resilient system 2 is constructed thereon in an outward direction relative to the circular coil 3. The magnetic system 4 is suspended on the resilient system 2 via the securing means 6 and is therefore movably supported relative to the coil 3 and the panel 5.

In vibration exciters 1, the size thereof, that is to say, the diameter of the coil 2, is generally determined in accordance with the size of the panel used and the use. The other elements

2, 4, 6 of the vibration exciter 1 are then arranged around that coil 2 so that, in the cross-section projection, the diameter of the whole vibration exciter 1 is thereby significantly greater than the diameter of the coil 3. The vibration exciter 1 thereby takes up a relatively large surface-area on the panel 5.

In principle, the fitting of such a vibration exciter 1 to the panel 5 can be carried out in various ways.

A first variant provides for the coil carrier of the vibration exciter to be adhesively bonded directly to the panel or also alternatively screwed to it. The screwing operation is relatively complex in terms of assembly in order to avoid vibrations. Although adhesively bonding the vibration exciters directly to the panel is relatively simple in terms of assembly, it makes subsequent changing of, for example, a malfunctioning, vibration exciter which is intended to be replaced more difficult and expensive.

Therefore, a second variant provides for the use of a so-called coupling ring 7 (see FIG. 1) between the panel 5 and the vibration exciter 1. During assembly, first the coupling ring 7 is adhesively bonded to the panel 5. Subsequently, the vibration exciter 1 is secured to the coupling ring 7.

In the above-mentioned vibration exciters 1 which have a very large diameter and therefore a large surface-area in the plan-view projection, the assembly thereof becomes difficult when, for example, there is used a panel which is flat but not necessarily level and instead substantially curved. With such curved panels, therefore, there is a need to use vibration exciters which are as small as possible.

SUMMARY OF THE INVENTION

On this basis, an object of the present invention is to provide a very compact vibration exciter in particular for or in a flat loudspeaker. Preferably, that vibration exciter is particularly intended to allow more rapid and precise assembly and disassembly without thereby destroying the entire flat loudspeaker.

According to the invention, at least one of the above-mentioned objects is achieved by vibration exciters having the features of claims 1 and 14 and/or by a flat loudspeaker having the features of claim 17 and/or by an aircraft having the features of claim 22.

Accordingly, there is provided:

A vibration exciter, in particular for or in a flat loudspeaker, in particular for use in the field of aviation and aerospace, having a vibration member carrier, having a coupling ring which serves to couple the vibration exciter to a sound transducer of a loudspeaker, with the vibration member carrier and the coupling ring being connected to each other by means of a quick-fit closure device which can be released again and which has first closure elements for a secure connection which is retained in relation to vibrations and which provides second closure elements, which are separate therefrom, for a firm connection between the vibration member carrier and the coupling ring.

A vibration exciter, in particular for or in a flat loudspeaker, in particular for use in the field of aviation and aerospace, having a coil carrier which carries a coil; having a vibration member carrier which is connected to the coil carrier and which has an inwardly directed resilient system which is inverted relative to the coil carrier in such a manner that the resilient system is arranged completely inside the structure of the coil carrier; having a coupling ring which serves to couple the vibration exciter to a sound transducer of the flat loudspeaker and which is releasably connected to the coupling ring by means of a closure device.

A flat loudspeaker, in particular for or in the field of aviation and aerospace, having a sound transducer for generating and transmitting acoustic waves, having a vibration exciter according to any one of the preceding claims, which is connected to the sound transducer and which is configured to excite the sound transducer for transmitting acoustic flexural waves.

A vehicle, in particular an aircraft or spacecraft, having at least one passenger compartment for vehicle passengers, having at least one flat loudspeaker according to at least one of the preceding claims, for acoustic irradiation of the passenger compartment, the panel of the flat loudspeaker itself forming a portion of the passenger compartment.

A first notion forming the basis of the present invention involves providing a so-called inverted construction of a vibration exciter. In that inverted construction of the vibration exciter, elements of the resilient system are substantially turned inwards. The "inward inversion" is carried out in relation to the coil carrier and the (annular gap) magnetic system. Whereas in previous solutions the resilient system and the securing of the magnetic system were arranged outside the securing means (relative to the centre point of the vibration exciter) and therefore outside the securing means of the coupling ring with respect to the panel, they are now displaced inwards. In this manner, vibration exciters with reduced diameters can be provided and are constructed, with the same functionality, so as to have a significantly smaller diameter and therefore have a more compact appearance. In particular, the proportion of the periphery thereof, that is to say, the portion which is determined by the resilient system and by securing the magnetic system and the coil system to the resilient system, is significantly reduced in such vibration exciters when viewed from above relative to the surface proportion of the coil system.

Such vibration exciters having an inverted structure advantageously offer the possibility of constructing coil diameters which are as large as possible with the smallest outside dimensions (outside diameters). That compact construction allows the efficiency of the vibration exciter to be substantially increased in relation to its dimensions. Owing to a reduced diameter of such a vibration exciter relative to known solutions, there results substantially improved suitability for securing such a vibration exciter according to the invention to curved panels, for example, flat loudspeaker panels which are curved in a convex or concave manner.

It is further possible also to construct this type of compact vibration exciter so as to have reduced weight.

According to the invention, the vibration exciter further has a vibration member carrier having an inner and an outer ring which are connected to each other with resilient elements. The inner ring of the vibration member carrier is fixed in position and the outer ring of the vibration member carrier that is connected to the coil carrier is coupled to a flat diaphragm by means of a coupling ring which is releasably connected to the vibration member carrier in order to generate sound. For that purpose, there are provided on the vibration member carrier and the coupling ring mutually opposed, complementary connection elements which can engage one in the other in the event of corresponding rotational movement and which consequently define a closure system. This construction makes possible assembly of the vibration exciter that is rapid and nevertheless very precise.

Another notion of the present invention involves providing a vibration exciter with a quick-fit closure. Such quick-fit closures typically have the advantage of very rapid and simple assembly of two components to be connected. However, a disadvantage in such quick-fit closures is that, as a result, the components which are intended to be connected to each other are also often not connected to each other very firmly and can again become separated in an undesirable manner, for example, owing to vibration or light manual actuation. However, this is a state which cannot be accepted in many applications, such as, for example, in air travel applications. In order to be able to meet the particular requirements, particularly for the assembly of vibration exciters in aviation and aerospace applications, according to the invention there is provided an improved closure mechanism in a vibration exciter between the coupling ring and the resilient system thereof. That closure mechanism according to the invention allows reversible connection of the resilient system of the vibration exciter and with the coupling ring thereof which can be secured to the panel in turn. That closure mechanism according to the invention is constructed in such a manner that, on the one hand, it can be assembled and also disassembled again very rapidly. On the other hand, it is now possible with this closure mechanism to produce a play-free connection between the coupling ring and the resilient system of the vibration exciter, by means of which the very strict vibration requirements particularly in air travel (in which up to 20 G are required) can be met more effectively.

According to the invention, the coupling ring and the resilient system of the vibration exciter have for this purpose two securing mechanisms which are separate from each other. The first securing mechanism is substantially constructed as a snap-fit closure. If the vibration exciter is screwed onto the coupling ring by means of the resilient system thereof, this can be achieved very easily firstly by means of a suitably adjusted flat ramp. Subsequently, there is provided a steep flank which indicates to the user engagement of the resilient system with respect to the coupling ring. However, that first securing mechanism is not used to produce firm securing, which to the greatest possible extent cannot be separated, between the coupling ring and the resilient system. Instead, it is simply intended in this instance that fixing and therefore retention of those two elements relative to each other be achieved and that the user be provided with an indication that an end position has been reached when the vibration exciter is screwed onto the coupling ring.

The firm connection between the coupling ring and the resilient system is brought about by means of a second securing mechanism. In that second securing mechanism, both the resilient system and the coupling ring have, as a closure mechanism, elements which engage with each other and in which a coupling ramp is incorporated. In the event of rotational movement of the vibration exciter and therefore the resilient system onto the coupling ring, correspondingly opposed coupling ramps are pushed one on the other with a small gradient. By increasingly pushing them one onto the other, there is therefore produced a firm connection of the elements to be connected, that is to say, the coupling ring and the resilient system, owing to frictional force. As a result, the connection stability can be adjusted by means of the force to be applied during that screwing action. However, no defined fixing or retention is provided by means of those coupling ramps because the ramp does not have an end stop, as is known. As already set out, this is provided by the first securing mechanism.

According to the invention, consequently, there is carried out mutual separation (in a spatial manner) of the elements which are responsible for retention and fixing, and therefore the end stop, from the elements which are provided to adjust the connection stability.

In this manner, the advantages of the two securing mechanisms can be combined with each other, that is to say, it is possible very rapidly to connect the resilient system to the coupling ring, which ensure a mutual connection which is very firm but nevertheless very secure.

Owing to its structure, the securing mechanism according to the invention effectively prevents independent disengagement, is caused, for example, by vibrations, of the connection between the coupling ring and the resilient system. That combined closure system further allows multiple repeated locking and re-opening, which involves an additional advantage in the case of a defective vibration exciter particularly during assembly and disassembly.

Advantageous constructions and developments of the invention will be appreciated from the other dependent claims and from the embodiments when viewed together with the drawings.

A preferred construction makes provision for the vibration exciter to have a coil carrier which carries a coil and a vibration member carrier which is connected to the coil carrier and which has a resilient system which is inwardly directed relative to the coil carrier.

A preferred construction makes provision for the quick-fit closure device to be constructed as mutually engaging connection elements of the vibration member carrier and the coupling ring.

A preferred construction makes provision for the first closure elements to have, on the vibration member carrier or the coupling ring, a securing finger which can engage in an engagement recess of the coupling ring or vibration member carrier for ensuring retention during a closure operation.

A preferred construction makes provision for the engagement recess to be formed by a securing ramp which has a steep ramp at the side of the engagement recess and which has a ramp which is very much flatter in comparison at the side opposite the engagement recess, and for the securing finger to move during a closure operation first along the flat ramp and subsequently along the steep ramp.

A preferred construction makes provision for the coupling ring and the resilient system to have as second closure elements mutually opposed and complementary receiving members for a play-free firm connection between the coupling ring and the resilient system.

A preferred construction makes provision for the complementary receiving members to be constructed in the form of pins which project at the periphery of the coupling ring and the resilient system.

A preferred construction makes provision for at least the first complementary receiving members to have internal grooves, behind which the second complementary receiving members can engage in the manner of a bayonet closure during a closure operation.

A preferred construction makes provision for the complementary receiving members each to have coupling surfaces which are opposite each other in the event of connection so that the coupling ring and the resilient system are firmly connected by means of a friction connection of the coupling surfaces.

A preferred construction makes provision for the complementary receiving members having the mutually opposed coupling surfaces to be constructed so as to be slightly wedge-shaped.

A preferred construction makes provision for a ramp of the complementary receiving members to have a gradient in the range from 3 to 8 degrees, preferably in the range from 3 to 6 degrees, relative to the connection plane thereof.

A preferred construction makes provision for the complementary receiving members to be arranged non-uniformly, in particular at irregular distances and/or with different sizes on a periphery of the vibration member carrier and/or the coupling ring.

A preferred construction makes provision for the vibration member carrier and the coupling ring to have, on mutually opposed end faces, engagement elements in the form of recesses in one end face and corresponding formations which are acted upon resiliently and which have the same shape and size in the other end face.

A preferred construction makes provision for an annular gap magnetic system which has an annular gap, the resilient system being arranged completely inside the annular gap.

A preferred construction makes provision for the vibration member carrier to have an inner ring and an outer ring which are connected via resilient elements of the resilient system, the coil carrier being secured to the outer ring in an irreversible manner.

A preferred construction makes provision for the sound transducer to have a flat panel which is of sandwich-like form and which has at least an upper covering layer, at least a lower covering layer and at least a preferably honeycombed core material which is arranged between those covering layers.

A preferred construction makes provision for the sound transducer to have a shape which is curved in at least one plane (y-z) and for the vibration exciter to be constructed in such a manner that it is secured in that curved plane (y-z).

A preferred construction makes provision for the vibration exciter and in particular the coupling ring of the vibration exciter to be connected to the sound transducer by an adhesion connection in an irreversible manner.

A preferred construction makes provision for the panel to have a substantially rectangular shape and for the vibration exciter to be arranged in particular in a central region of the panel.

A preferred construction makes provision for the portion of the passenger compartment to be constructed as an inner covering, preferably in a roof or wall region of the passenger compartment, as a portion of a passenger supply duct and/or as a portion of a seat.

BRIEF DESCRIPTION OF THE DRAWINGS

The present invention is explained in greater detail below with reference to the embodiments set out in the schematic figures of the drawings, in which.

DESCRIPTION OF EXEMPLARY EMBODIMENTS

Figure 1:
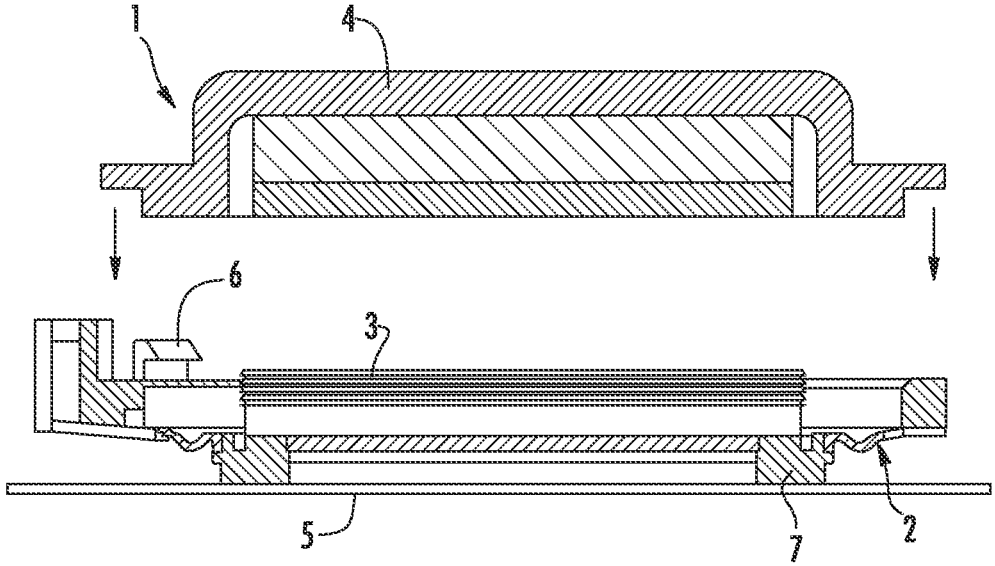
FIG. 1 is a cross-section of a known vibration exciter mounted on a panel.

In the figures of the drawings, elements and features which are identical and functionally identical have been given the same reference numerals, unless otherwise indicated.

Figure 2:
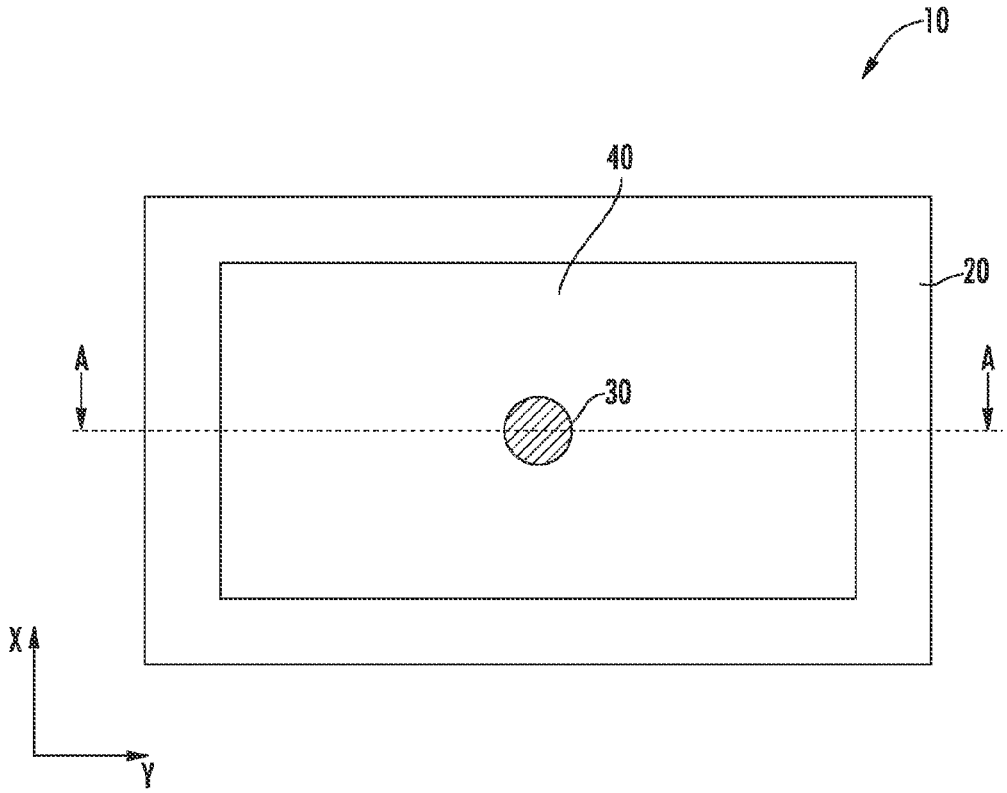
FIG. 2 is a top view of a highly simplified flat loudspeaker according to the invention.

FIG. 2 is a perspective view of a flat loudspeaker 1 according to one embodiment of the present invention.

The flat loudspeaker 10 which is illustrated here in a greatly simplified manner has a panel 20 which is preferably substantially rectangular and a vibration exciter 30 which is arranged substantially centrally thereon and which is connected to the panel 20.

Figure 1A:
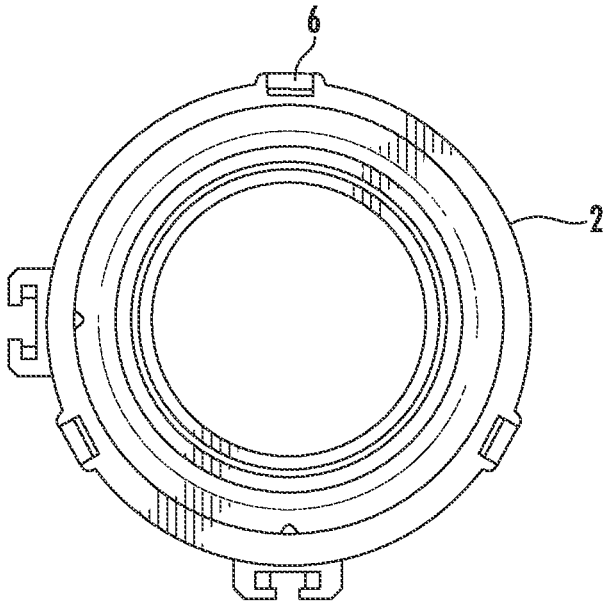
FIG. 1A is a top view of the resilient system of FIG. 1.
Figure 2A:
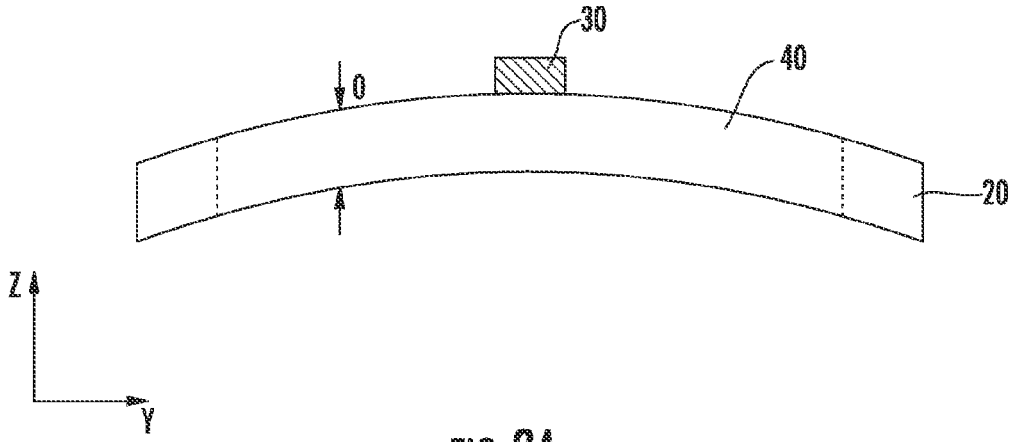
FIG. 2A is a cross-section of the flat loudspeaker of FIG. 2.

The panel 20 which forms the diaphragm of the flat loudspeaker and therefore the sound transducer thereof extends in a planar manner substantially in the x-y plane and curves with a small radius, as can be seen in FIG. 2A, in the y-z plane. In the assembly position of the flat loudspeaker 10 illustrated, the x axis is directed, for example, towards the nose in a longitudinal direction of an aircraft, the y direction extends from right to left in a transverse direction of an aircraft and the z direction extends in a vertical direction of an aircraft. The panel 20 has a sandwich material which, for example, comprises an upper covering layer, a lower covering layer and a honeycombed material arranged therebetween (not illustrated in FIGS. 1, 1A). The honeycombs of the honeycombed material extend substantially perpendicularly relative to the panel plane x-y. Preferably, the upper covering layer and the lower covering layer are produced from a composite glass fibre material and the honeycombed material is produced from a paper or a material similar to paper. The lower covering layer is directed towards the inner space of the cabin, that is to say, towards the passengers, in the assembly position of the flat loudspeaker 10. The upper covering layer is preferably connected directly to the vibration exciter 30.

The panel 20 is preferably secured by means of retention elements in a supply duct of an aircraft (not illustrated here).

The panels 20 used in aircraft construction for a flat loudspeaker preferably have a surface-area preferably of approximately from 100 $cm^2$ to 2000 $cm^2$ and preferably of approximately 600 $cm^2$, a thickness D of approximately from 3 mm to 10 mm and preferably of approximately 6 mm and a weight of approximately from 100 $g/m^2$ to 2000 $g/m^2$ and preferably of approximately 600 $g/m^2$. The cell width of an individual honeycomb of the honeycombed material is from 2 mm to 4 mm and preferably approximately 3.2 mm.

The vibration exciter 30 which typically comprises a magnet and a vibration coil is merely schematically illustrated in FIG. 2 for the sake of clarity. The vibration exciter 30 may be fitted at any location on the panel 20 although a middle position 40 which is as central as possible is preferred, for example, for reasons of better weight equipartition.

In electrodynamic loudspeakers 10, the diaphragm 20 thereof is driven by the interaction between an electric current and a constant magnetic field using the vibration generator 30 (or also exciter or transducer). Such electrodynamic loudspeakers 10 use Lorentz force as a power source. The electrodynamic loudspeaker 10 has a central coil, the so-called vibration coil, through which electric current flows and which is arranged in a constant magnetic field of a permanent magnet. For example, ferrites, aluminium, nickel, cobalt and the like, are used as permanent magnetic material. The coil is located on a vibration coil carrier which is secured to the flat panel in the case of a flat loudspeaker. The coil and the diaphragm can preferably move back and forth in the magnetic field in the direction perpendicular relative to the field strength distribution. If an alternating current is now fed through the coil, a force is applied to the diaphragm owing to the Lorentz force and causes it to vibrate. Consequently, flexural waves which can be heard as acoustic waves are produced in the diaphragm.

Figure 3:
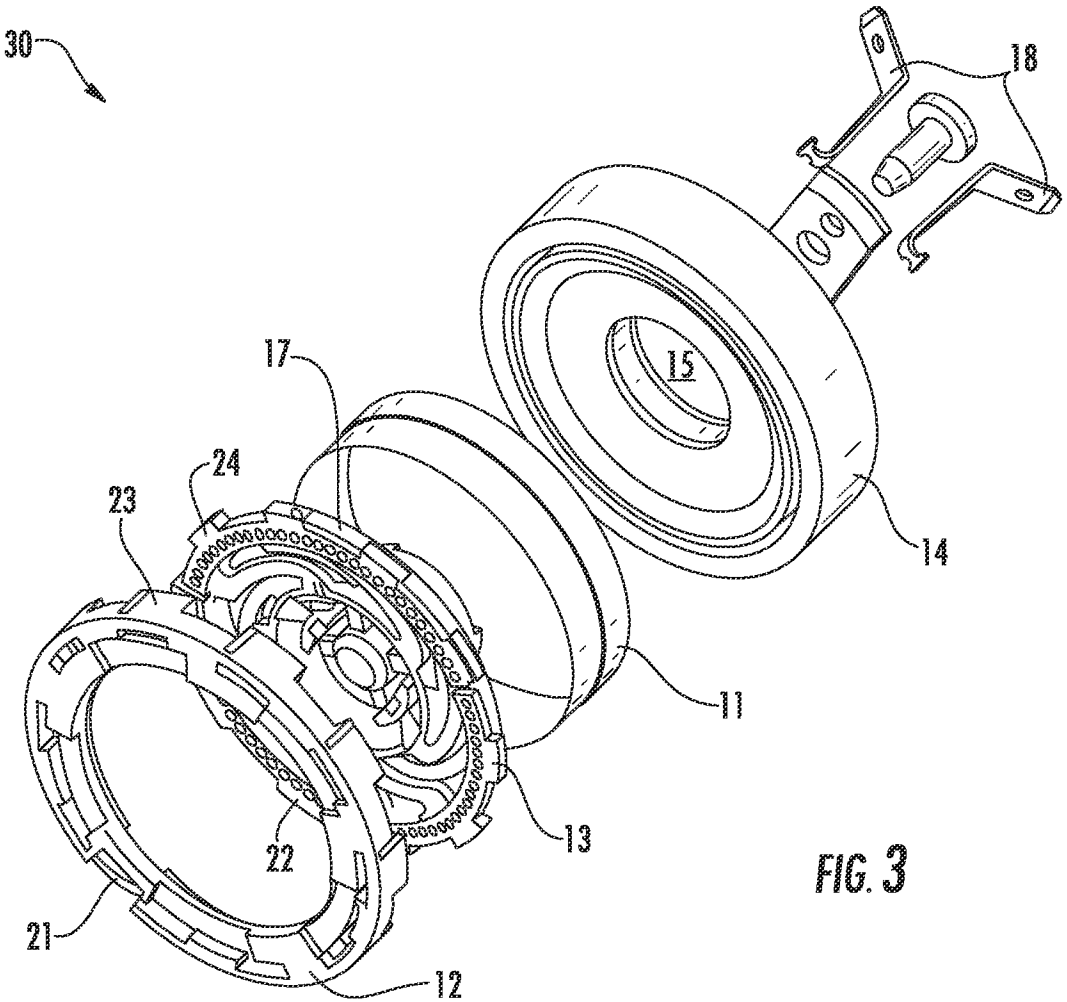
FIG. 3 is an exploded illustration of a first detailed embodiment of a vibration exciter according to the invention.
Figure 3A:
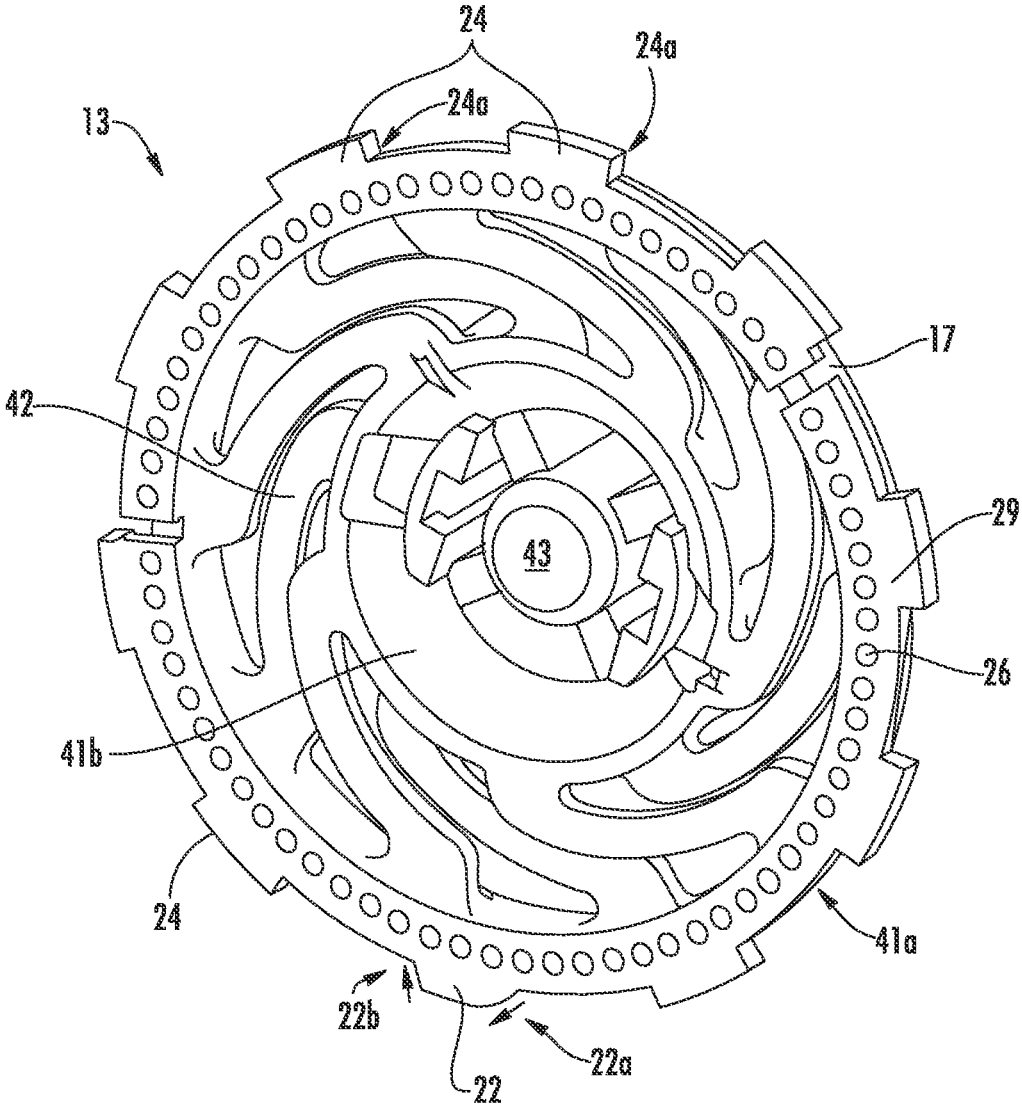
FIG. 3A is a perspective view of the end face of the resilient system of the vibration exciter of FIG. 3 according to the invention.

FIG. 3 is an exploded view of a first detailed embodiment of a vibration exciter according to the invention. FIG. 3A shows the construction of the resilient system thereof. The vibration exciter 30 according to the invention has an inverted construction, that is to say, the resilient system is arranged completely inside the magnetic system in that vibration exciter.

In FIG. 3, the vibration exciter is designated 30. The vibration exciter 30 has a coil carrier 11, a resilient system 13, a coupling ring 12 and an annular magnetic system 14. The elements 11, 12, 13, 14 of the vibration exciter 30 are preferably constructed so as to be circular so that the vibration exciter 30 has a generally substantially flat, cylindrical construction conferred on it. The vibration exciter 30 further contains an electrical connection device 18, by means of which the vibration exciter 30 can be supplied with electric current.

The coil carrier 11 is used to receive a coil. The coil which is arranged inside the housing of the coil carrier 11 but which is not explicitly illustrated in FIG. 1 is constructed as a plunger coil in the present case. Plunger coils are (magnetic) coils which are suspended resiliently in a stationary magnetic field and which are deflected in the event of a flow of current by Lorentz force. The plunger coil therefore produces, when current flows, a force (Lorentz force) which is directed transversely relative to the wire of the plunger coil and the magnetic field (that is to say, longitudinally relative to the coil). That force is proportional to the current. The force is used to induce the flexural waves in the panel 20. In the event of movement, the coil itself induces an electromagnetic counterforce, that is to say, a voltage which opposes the driving voltage. By the direction of electric current being reversed, the direction of the force changes. Therefore, such plunger coil magnetic systems are suitable inter alia for converting alternating current voltages into mechanical vibrations, as is required in a vibration exciter 30 for a loudspeaker.

To that end, the coil housing 11 in the assembled state is firmly connected (for example, adhesively bonded) to the housing of the resilient system 13 and secured in an irreversible manner at that location as a result. The resilient system 13 forms the vibration member carrier of the vibration exciter 30. That resilient system 13 has an inner ring 41*b* and an outer ring 41*a* which are connected to each other partially resiliently by means of resilient elements 42 (see FIG. 3A). The outer ring 41*a* provided at the outer side acts as a coil securing means 17 for the coil housing. The resilient system 13 further has various resilient elements 42 which are located inwardly in relation to the coil securing means 17 in order to secure the resilient system 13 to the coupling ring 12. The inner ring 41*b* of the vibration member carrier 13 is rigid whereas the outer ring 41*a* of the vibration member carrier 13 connected to the coil carrier 11 is coupled to a planar diaphragm 20 by means of the coupling ring 12 in order to produce sound.

The resilient system 13 further has a central recess 43. Based on the circular ring of the coil securing means 17, the resilient system 13 is constructed with its internally arranged resilient elements 42 on an inverted structure and can be connected to the magnetic system 14 by means of the receiving member 15. The magnetic system 14 also has a central hole 15 so that the inner circular ring 41*b* of the resilient system 13 can be connected to the magnetic system 14 firmly, that is to say, rigidly. Preferably, the electrical connections 18 which are provided to supply the coil 11 are also directed through that inner hole 15 of the magnetic system 14.

The resilient system 13 with the coil 11 secured thereto is pushed into the coupling ring 12 during assembly and, for example, connected to the coupling ring 12 in a reversible manner by means of a rotary quick-fit closure. For that purpose, there are provided on the vibration member carrier 13 and the coupling ring 12 mutually opposed, complementary connection elements which can engage one in the other during rotational movement and which consequently define a closure system. That construction allows assembly of the vibration exciter that is rapid and nevertheless very precise. The corresponding connection mechanism is explained in detail below.

The coupling ring 12 is secured to the panel 20 of the loudspeaker 10 (not illustrated in FIGS. 3 and 3A) during assembly by means of a connection which is preferably but not necessarily irreversible. Such irreversible connection may be, for example, an adhesive connection.

Figure 3B:
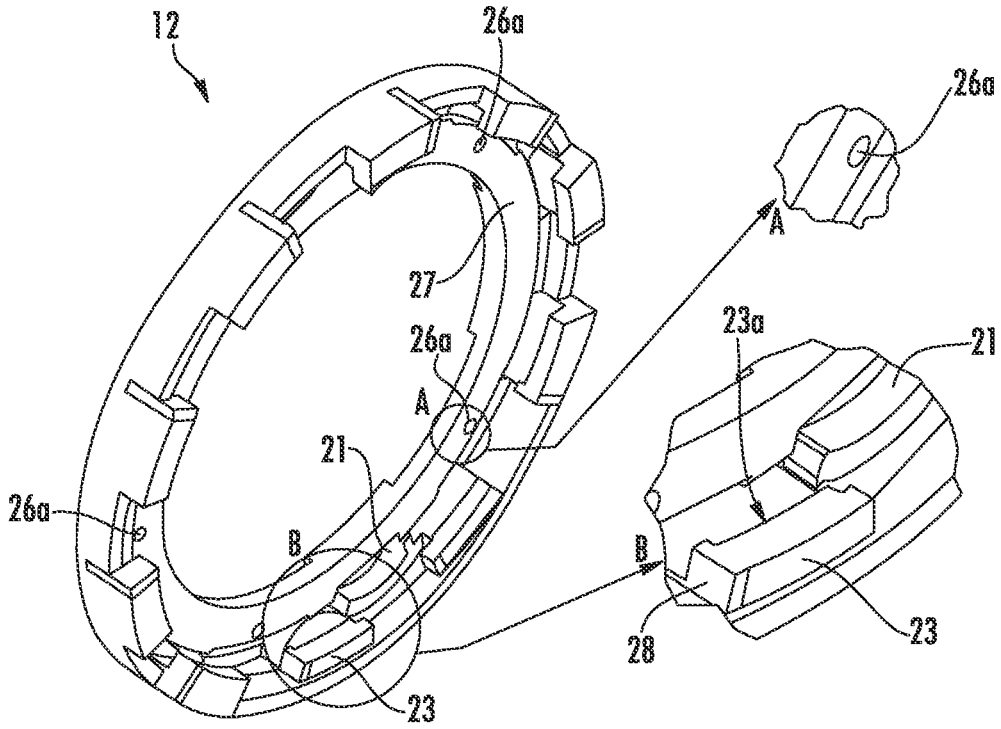
FIG. 3B is a perspective view of the inner side of the coupling ring of the vibration exciter of FIG. 3 according to the invention.

The coupling ring 12 and the resilient system 13 have a combined securing mechanism which further allows quick-fit closure. The securing mechanism according to the invention comprises two significant components. Firstly, at least one securing finger 21 is provided on the coupling ring. Secondly, the coupling ring 12 and the resilient system 13 have mutually complementary receiving members 23, 24 for play-free, firm connection. FIG. 3B is a detail of the coupling ring 12 from the side thereof facing the resilient system 13. FIG. 3B shows the construction and function of the complementary receiving members 23, 24 and the securing finger 21.

In the present embodiment, those complementary receiving members 23, 24 are constructed in the form of pins which project at the periphery of the coupling ring 12 and resilient system 13. The pins 24 of the resilient system 13 project radially, whereas the pins 23 of the coupling ring 12 project axially in the direction of the resilient system 13 and have internal grooves 25. These internal grooves 25 are configured so that the pins 24 of the resilient system 13 can engage behind those grooves 25 for the closure mechanism. That coupling principle is comparable with a bayonet closure, in which one ring (that is to say, the elements 24 of the resilient system 13) is pushed behind the receiving members of the other ring (that is to say, the elements 23 of the coupling ring 12) and an axial closure is produced by means of mutual displacement of those two rings.

In order also to produce a firm connection in addition to the axial closure, the two complementary receiving members 23, 24 have coupling surfaces 23*a*, 24*a* which serve to connect those complementary receiving members 23, 24 to each other when the two elements 12, 13 are moved rotationally. Those coupling surfaces 23*a*, 24*a* are arranged opposite each other in the connection state so that the coupling ring 12 and the resilient system 13 in that case are firmly connected by means of frictional connection of the coupling surfaces 23*a*, 24*a*, respectively.

Those complementary receiving members 23, 24 with the mutually opposed coupling surfaces are constructed so as to be slightly wedge-shaped and therefore have a very small ramp in order to produce the firm connection owing to the wedge action of the ramp when the coupling surfaces 23*a*, 24*a* are pushed one onto the other. Preferably, the complementary receiving members 23, 24 have a ramp whose coupling surfaces 23*a*, 24*a* are at least 3 degrees and a maximum of 8 degrees and preferably a ramp in the range between 3 and 6 degrees relative to the connection plane. A play-free connection, that is to say, a positive-locking connection with pretension, can thereby be brought about between the coupling ring 12 and the resilient system 13. Those so-called coupling ramps 23*a*, 24*a* of the complementary receiving members 23, 24 simultaneously perform the functions of protection against excess rotation of the coupling ring 12 relative to the resilient system 13 so that no additional end stop is necessary.

For a clear rotational orientation, those complementary receiving members 23, 24 are preferably distributed in a non-uniform manner over the periphery of the coupling ring 12 and the resilient system 13 and/or are constructed with different sizes.

Greater stability is achieved than is the case in known closure systems with upright connection hooks owing to that arrangement of the complementary receiving members 23, 24 on a closed circular ring of the resilient system 12 or the coupling ring 13. As a result, it is possible in a more advantageous manner in the overall configuration of the vibration exciter 10 according to the invention for the resilient elements 42 of the resilient system 13 to constitute the weakest component of the vibration exciter 10 in the assembled state. Consequently, those resilient elements 42 act as a desired breaking location in the event of mechanical overloading of the vibration exciter 10 according to the invention. Since the coupling ring 12 is typically secured to the panel 20 in an irreversible manner, only the resilient system 13 and in particular the resilient elements 42 thereof in this case become damaged in the event of mechanical overloading. However, that resilient system 13 can be unscrewed from the coupling ring 12 again owing to the reversible closure system. In that manner, the relatively expensive panel 20 does not have to be replaced if mechanical overloading of the vibration exciter 10 occurs. In that instance, only the vibration exciter 10 secured to the coupling ring (without the coupling ring 12) and typically even only the resilient system 12 has to be replaced.

At least one securing finger 21 for retaining and fixing the resilient system 13 relative to the coupling ring 12 is further provided on the coupling ring. The at least one securing finger 21 is constructed so as to be at least partially movable in a radial direction of the coupling ring 12 (see arrow in FIG. 3) and further presses with pretension onto the outer circular ring 41*a* of the complementary resilient system 13. Preferably, that securing finger 21 and a securing ramp 22 which is opposite the securing finger 21 are constructed in such a manner that one side 22*a* (right-hand side of the element 22 in FIG. 3A) has a flat ramp gradient and the opposite side 22*b* (left-hand side of the element 22 in FIG. 3A) has a far steeper ramp gradient (approximately 90 degrees relative to the ramp). Therefore, that securing ramp 22 is constructed in such a manner that the closure operation of the resilient system 13 acts against the coupling ring 12 at first with a relatively low application of force because in this instance the securing finger 21 first extends along the flat ramp 22*a*. During an operation involving the resilient system 13 being screwed and therefore closed onto the coupling ring 12, the application of force changes and therefore the torque also changes owing to the ramp shapes mentioned. Shortly before the end position (engagement position) is reached, the necessary closure torque is abruptly reduced because the securing finger 21 than moves into engagement with the steep ramp 22*b* of the element 22 so that a user receives, in a manner of speaking, an indication concerning the closure operation by means of the torque which has to be applied by him. However, the opening operation involves a far greater application of force because the securing finger 21 first has to be moved along the steep ramp 22*b* in this instance.

Wear-free opening and re-closing and simple and effective assembly and disassembly of the vibration exciter quick-fit closure is ensured because the two securing ramps 22*a*, 22*b* of the element 22 are constructed without edges.

A plurality of engagement recesses 26 are further provided circumferentially on the outer ring 41*a* of the resilient system 13. In this instance, those engagement recesses 26 are provided in the outer ring 418 as preferably circular recesses which are constructed in the surface 29 opposite the coupling ring on the end face. The coupling ring 12 further has, on the inner surface 27 directed towards the resilient system 13, a plurality of engagement elements 26*a* in the form of a size and shape corresponding to the engagement recesses 26, which protrudes from the inner surface 27 of the coupling ring 12 in a substantially hemispherical manner. If the outer resilient ring 418 of the resilient system 13 is displaced with the engagement recesses 26 thereof relative to that engagement element 26*a*, additional engagement and therefore fixing can thereby be brought about. That engagement element 26*a* is preferably acted upon resiliently in an inward direction and is consequently flexible.

Stop elements 28 are further provided in the grooves 25 of the complementary receiving members 23 of the coupling ring 12. Those stop elements 28 serve to stop the corresponding complementary elements in the event of rotational movement of the resilient system 13 on the coupling ring 12.

Although the present invention has been described above with reference to preferred embodiments, it is not limited thereto but instead can be modified and developed in various ways.

In the present patent application, the coupling ring is considered to be a component of the vibration exciter even if it is constructed so as to be detachable from the resilient system.

The coupling ring of the vibration exciter can be secured to the panel of a flat loudspeaker in any manner, for example, by screwing, adhesive-bonding, snap-fitting and the like.

Apart from the above-mentioned advantages of the inverted construction and the quick-fit closure according to the invention, the operation and therefore the principle of that vibration exciter corresponds to known embodiments which are generally known to the person skilled in the art and which, for that reason, are not intended to be set out in greater detail here.

Although the present invention has been described with reference to a vibration exciter for a flat loudspeaker, it is not limited thereto but instead can also be used advantageously in any loudspeakers which do not necessarily have to be constructed so as to be flat. Furthermore, the flat loudspeakers also do not necessarily have to be constructed so as to be curved but can also be constructed so as to be completely flat.

The invention is also not necessarily limited to a vehicle constructed as an aircraft and is particularly not limited to the inner covering thereof. Instead, the above-described flat loudspeaker technology can also advantageously be used in any vehicles such as, for example, buses, ships and the like, and also not necessarily in the inner covering thereof in this instance.

The invention is also not limited to the above quantities set out. Instead, for example, more than only one securing finger can also be used. The information concerning sizes and thicknesses is also intended to be understood only by way of example.

LIST OF REFERENCE NUMERALS

1 Vibration exciter
2 Resilient system
3 Coil
4 Magnetic system
5 Panel
6 Securing of the magnetic system to the resilient system
7 Coupling ring
10 Flat loudspeaker
11 Coil carrier for a/an (immersion) coil
12 Coupling ring
13 Resilient system
14 Magnetic system, annular magnetic system
15 Central hole
17 Coil securing means
18 Electrical connection device
20 Panel
21 Securing finger
22 Securing ramp
22*a* Flat ramp
22*b* Steep ramp
23, 24 Complementary receiving members of the resilient system or coupling ring
23*a*, 24*a* Coupling surfaces of the complementary receiving members
25 Internal grooves of the complementary receiving member of the coupling ring
26 Engagement elements
26*a* Engagement element
27 Internal surface of the coupling ring
28 Stop
29 End-face surface of the outer ring of the resilient system
30 Vibration exciter
40 Central location of the panel
41*a* Outer ring of the resilient system
41*b* Inner ring of the resilient system
42 Resilient elements between the inner and outer ring
43 Central recess
D Thickness
X, Y, Z Directions relative to the orientation of an aircraft

The invention claimed is:

1. A vibration exciter for a flat loudspeaker, in particular for use in the field of aviation and aerospace, comprising:
- a vibration member carrier,
- a coil carrier for carrying a coil, and
- a coupling ring which serves to couple the vibration exciter to a sound transducer of a loudspeaker,
- wherein the vibration member carrier and the coupling ring are connected to each other by a releasable quick-fit closure device which has first closure elements for a secure connection retained in relation to vibrations and which provides second closure elements, which are separate therefrom, for a firm connection between the vibration member carrier and the coupling ring,
- wherein the vibration member carrier is connected to the coil carrier and comprises a resilient system which is inwardly directed relative to the coil carrier.

2. The vibration exciter of claim 1, wherein the quick-fit closure device is constructed as mutually engaging connection elements of the vibration member carrier and the coupling ring.

3. The vibration exciter of claim 1, wherein the first closure elements comprise, on the vibration member carrier or the coupling ring, a securing finger which can engage in an engagement recess of the coupling ring or vibration member carrier for ensuring retention during a closure operation, in particular wherein the engagement recess is formed by a securing ramp which comprises a steep ramp at the side of the engagement recess and which comprises a ramp which is very much flatter in comparison at the side opposite the engagement recess, and in that the securing finger moves during a closure operation first along the flat ramp and subsequently along the steep ramp.

4. The vibration exciter of claim 1, wherein the coupling ring and the resilient system comprise as second closure elements mutually opposed and complementary receiving members for a play-free firm connection between the coupling ring and the resilient system, in particular wherein the complementary receiving members are constructed in the form of pins which project at the periphery of the coupling ring and the resilient system.

5. The vibration exciter of claim 4, wherein at least the first complementary receiving members comprise internal grooves, behind which the second complementary receiving members can engage in the manner of a bayonet closure during a closure operation.

6. The vibration exciter of claim 4 wherein each complementary receiving member comprises coupling surfaces which are opposite each other in the event of connection so that the coupling ring and the resilient system are firmly connected by a friction connection of the coupling surfaces.

7. The vibration exciter of claim 6, wherein the complementary receiving members comprising the mutually opposed coupling surfaces are constructed so as to be slightly wedge-shaped, in particular wherein a ramp of the complementary receiving members has a gradient in the range from 3 to 8 degrees, preferably in the range from 3 to 6 degrees, relative to the connection plane thereof.

8. The vibration exciter of claim 4, wherein the complementary receiving members are arranged non-uniformly, in particular at irregular distances and/or with different sizes on a periphery of the vibration member carrier and/or the coupling ring.

9. The vibration exciter of claim 1, wherein the vibration member carrier and the coupling ring comprise, on mutually opposed end faces, engagement elements in the form of recesses in one end face and corresponding formations which are acted upon resiliently and which have the same shape and size in the other end face.

10. A vibration exciter for a flat loudspeaker comprising:

a coil carrier which carries a coil;

a vibration member carrier which is connected to the coil carrier and which has an inwardly directed resilient system which is inverted relative to the coil carrier in such a manner that the resilient system is arranged completely inside the structure of the coil carrier;

a coupling ring which serves to couple the vibration exciter to a sound transducer of the flat loudspeaker and which is releasably connected to the coupling ring by a closure device.

11. The vibration exciter of claim 10, wherein an annular gap magnetic system which has an annular gap, the resilient system being arranged completely inside the annular gap or wherein the vibration member carrier has an inner ring and an outer ring which are connected via resilient elements of the resilient system, the coil carrier being secured to the outer ring in an irreversible manner.

12. A flat loudspeaker, in particular for or in the field of aviation and aerospace, comprising:

a sound transducer for generating and transmitting acoustic waves, a vibration exciter for a flat loudspeaker comprising:

a vibration member carrier, a coil carrier which carries a coil, and a coupling ring which serves to couple the vibration exciter to a sound transducer of a loudspeaker, wherein the vibration member carrier and the coupling ring are connected to each other by a releasable quick-fit closure device which has first closure elements for a secure connection locked in relation to vibrations and which provides second closure elements, which are separate therefrom, for a firm connection between the vibration member carrier and the coupling ring, wherein the vibration member carrier is connected with the coil carrier and has a resilient system that is inwardly directed relative to the coil carrier;

wherein the vibration exciter is connected to the sound transducer and is configured to excite the sound transducer for transmitting acoustic flexural waves.

13. The flat loudspeaker of claim 12, wherein the sound transducer has a flat panel which is of sandwich-like form and which has at least an upper covering layer, at least a lower covering layer and at least a preferably honeycombed core material which is arranged between those covering layers.

14. The flat loudspeaker of claim 12, wherein the sound transducer has a shape which is curved in at least one plane and in that the vibration exciter is constructed in such a manner that it is secured in that curved plane.

15. The flat loudspeaker of claim 12, wherein the vibration exciter and in particular the coupling ring of the vibration exciter is connected to the sound transducer by an adhesion connection in an irreversible manner.

16. The flat loudspeaker of claim 12, wherein the panel has a substantially rectangular shape, and in that the vibration exciter is arranged in particular in a central region of the panel.

17. A flat loudspeaker, in particular for or in the field of aviation and aerospace, comprising:

a sound transducer for generating and transmitting acoustic waves, and a vibration exciter for a flat loudspeaker comprising:

a coil carrier which carries a coil;

a vibration member carrier which is connected to the coil carrier and which has an inwardly directed resilient system which is inverted relative to the coil carrier in such a manner that the resilient system is arranged completely inside the structure of the coil carrier; and a coupling ring which serves to couple the vibration exciter to a sound transducer of the flat loudspeaker and which is releasably connected to the coupling ring by a closure device, wherein the vibration exciter is connected to the sound transducer and is configured to excite the sound transducer for transmitting acoustic flexural waves.

18. The flat loudspeaker of claim 17, wherein the sound transducer has a flat panel which is of sandwich-like form and which has at least an upper covering layer, at least a lower covering layer and at least a preferably honeycombed core material which is arranged between those covering layers.

19. The flat loudspeaker of claim 17, wherein the sound transducer has a shape which is curved in at least one plane and in that the vibration exciter is constructed in such a manner that it is secured in that curved plane.

20. The flat loudspeaker of claim 17, wherein the vibration exciter and in particular the coupling ring of the vibration exciter is connected to the sound transducer by an adhesion connection in an irreversible manner.

21. The flat loudspeaker of claim 17, wherein the panel has a substantially rectangular shape, and in that the vibration exciter is arranged in particular in a central region of the panel.

22. A vehicle, in particular aircraft or spacecraft, comprising:

at least one passenger compartment for vehicle passengers, at least one flat loudspeaker having a sound transducer for generating and transmitting acoustic waves, and a vibration exciter for a flat loudspeaker, comprising:

a vibration member carrier, a coil carrier which carries a coil, and a coupling ring which serves to couple the vibration exciter to a sound transducer of a loudspeaker, wherein the vibration member carrier and the coupling ring are connected to each other by a releasable quick-fit closure device which has first closure elements for a secure connection in relation to vibrations and which provides second closure elements, which are separate therefrom, for a firm connection between the vibration member carrier and the coupling ring, and wherein the vibration member carrier is connected with the coil carrier and has a resilient system that is inwardly directed relative to the coil carrier;

wherein the vibration exciter is connected to the sound transducer and is configured to excite the sound transducer for transmitting acoustic flexural waves, for acoustic irradiation of the passenger compartment, the panel of the flat loudspeaker itself forming a portion of the passenger compartment.

23. The vehicle of claim 22, wherein the portion of the passenger compartment is constructed as an inner covering, preferably in a roof or wall region of the passenger compartment, as a portion of a passenger supply duct and/or as a portion of a seat.

* * * * *

UNITED STATES PATENT AND TRADEMARK OFFICE

CERTIFICATE OF CORRECTION

PATENT NO. : 8,542,860 B2
APPLICATION NO. : 12/827285
DATED : September 24, 2013
INVENTOR(S) : Henning Scheel et al.

It is certified that error appears in the above-identified patent and that said Letters Patent is hereby corrected as shown below:

On title page, item (75) Inventors:

-- Please add inventors "Michael Hein, Hamburg (DE); Rolf Janke, Hamburg (DE)" --

Signed and Sealed this
Eighth Day of March, 2016

Michelle K. Lee

Michelle K. Lee
*Director of the United States Patent and Trademark Office*